United States Patent [19]

Hillenbrand

[11] 4,044,502

[45] Aug. 30, 1977

[54] CONTAINER FOR FLOWERS

[76] Inventor: George C. Hillenbrand, Sabal Ridge Apts., Apt. 9N, 750 S. Ocean Blvd., Boca Raton, Fla. 33432

[21] Appl. No.: 665,629

[22] Filed: Mar. 10, 1976

[51] Int. Cl.[2] ..... A47G 7/07

[52] U.S. Cl. ..... 47/41.12; 47/41.11

[58] Field of Search ..... 47/34.11, 41–41.13; 206/423

[56] References Cited

U.S. PATENT DOCUMENTS

| | | | |
|---|---|---|---|
| 720,132 | 2/1903 | Green | 47/41.11 |
| 1,423,906 | 7/1922 | Brettschneider | 47/41.11 |
| 2,126,766 | 8/1938 | Gerbermann | 47/41.11 |
| 3,336,697 | 8/1967 | Davis | 47/41.12 |
| 3,812,617 | 5/1974 | Brody | 47/41 |

FOREIGN PATENT DOCUMENTS

| | | | |
|---|---|---|---|
| 22,557 of | 1909 | United Kingdom | 47/41.11 |
| 253,227 | 6/1926 | United Kingdom | 47/41 |

*Primary Examiner*—Robert E. Bagwill

*Attorney, Agent, or Firm*—James W. Pearce; Roy F. Schaeperklaus

[57] ABSTRACT

A flower container having a bottom and an annular wall terminating in an upwardly opening mouth. A plurality of lugs is mounted on the wall adjacent the mouth, there being upright sockets in the lugs. Plugs are mounted in the sockets. Flexible straps span opposed plugs. The straps hold a block of flower holding material in the container.

4 Claims, 6 Drawing Figures

FIG. 2
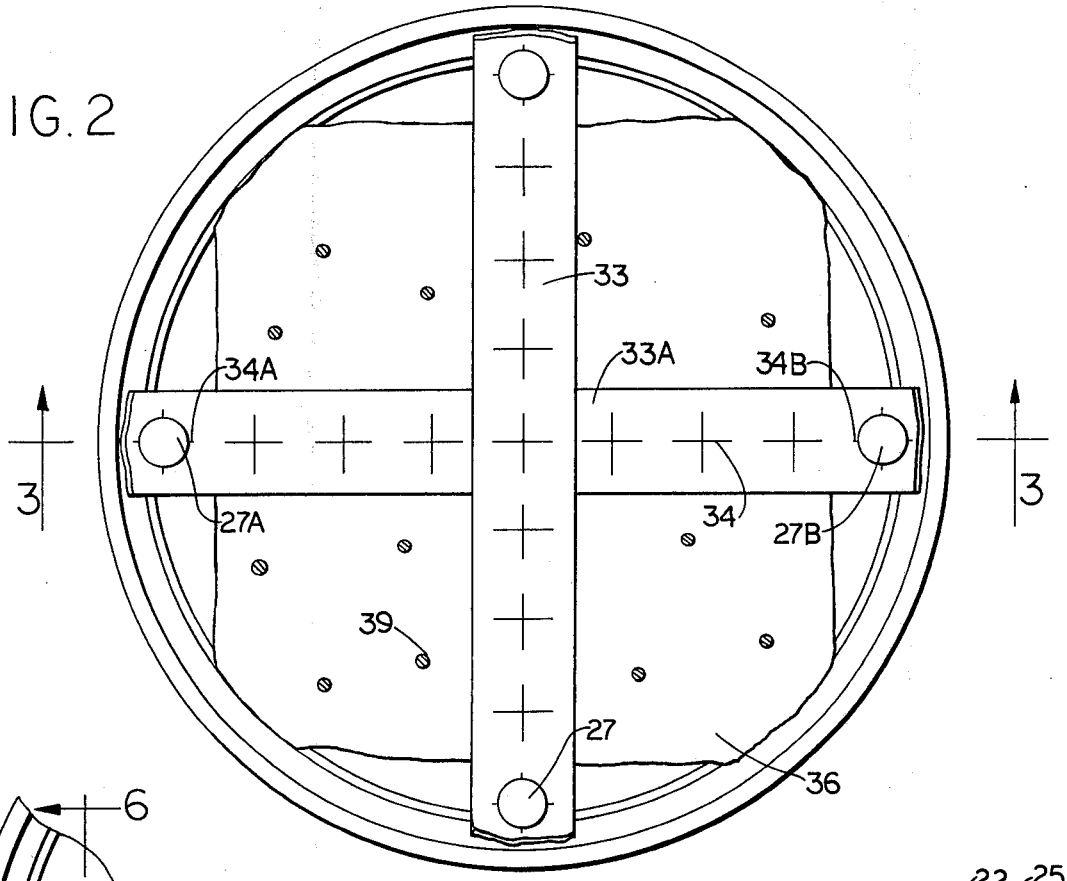
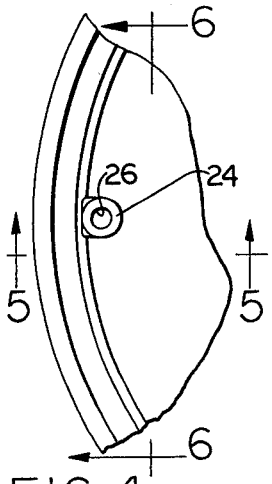
FIG. 4
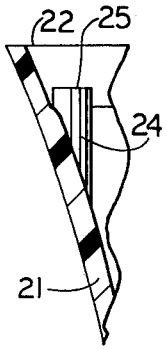
FIG. 5
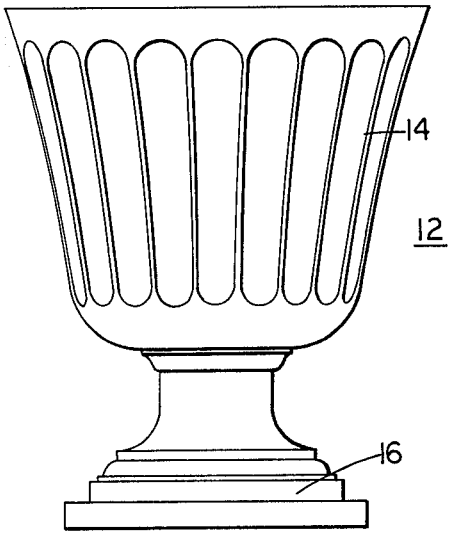
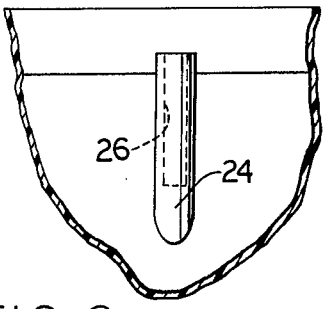
FIG. 6
FIG 1

CONTAINER FOR FLOWERS

This invention relates to containers for flowers. More particularly, this invention relates to a container in which flowers are securely anchored in position.

An object of this invention is to provide a molded flower container having lugs molded on the interior of a wall thereof to support ends of tie-down members that hold a lump of porous material in which stalks of the flowers are inserted.

A further object of this invention is to provide a molded flower container in which lugs molded in the walls of the container are provided with upright sockets in which plugs are mounted for securing ends of the tie-down members.

Briefly, this invention provides a flower container which includes a hollow molded body. On inner surfaces of walls of the body adjacent an open mouth thereof are formed lugs of the sort used in discharging the body from a mold. Upright sockets are formed in the lugs. Plugs are mounted in the sockets with a portion of a shaft of each plug exposed and a head portion of each lug overlying the associated lug. Cross tie members can then be attached to span opposed plugs and extend crosswise of the container in position to hold a lump of flower holding material inside the body. The cross tie members can be ribbons provided with spaced openings which receive the plugs.

The above and other objects and features of the invention will be apparent to those skilled in the art to which this invention pertains from the following detailed description and the drawings, in which:

FIG. 1 is a view in side elevation of a flower container constructed in accordance with an embodiment of this invention;

FIG. 2 is a top plan view thereof on an enlarged scale;

FIG. 4 is a fragmentary plan view of the container with cross ties, flowers and flower supporting lump removed;

FIG. 5 is a view in section taken on the line 5—5 in FIG. 4; and

FIG. 6 is a fragmentary view in section taken on the line 6—6 in FIG. 4.

In the following detailed description and the drawings, like reference characters indicate like parts.

Figure 3:
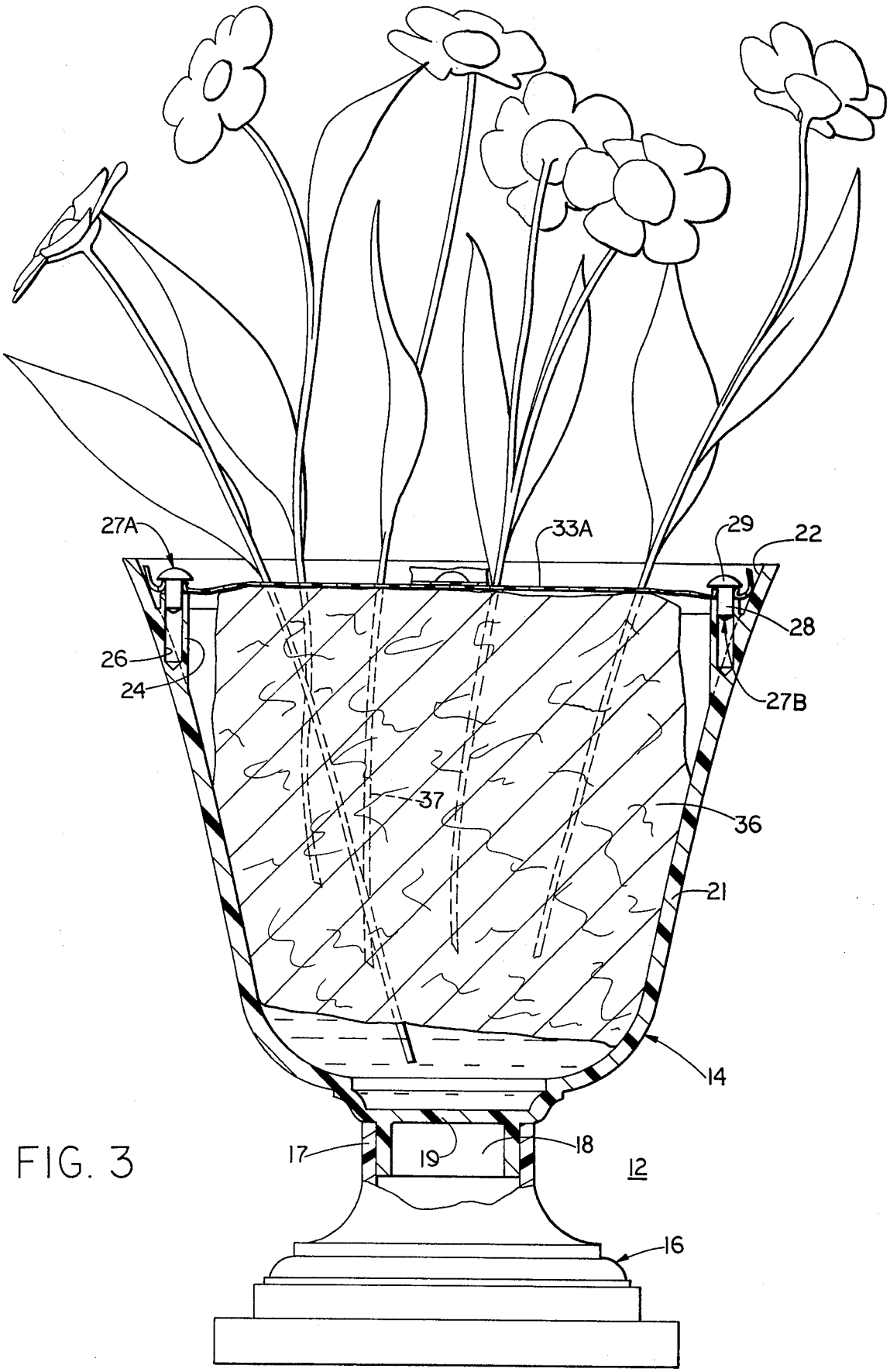
FIG. 3 is a view in section taken on the line 3—3 in FIG. 2, flowers being shown mounted in the container.

In FIG. 1 is shown a flower container 12 constructed in accordance with an embodiment of this invention. The container 12 includes a molded body 14 and a molded base 16. The body 14 and the base 16 can be molded of a thermoplastic resin such as polystyrene. As shown in FIG. 3, a tubular upper portion 17 of the base 16 telescopically receives a tubular lower end portion 18 of the body 14. The tubular lower end portion 18 underlies a bottom wall 19 of the container body 14. Upwardly and outwardly of the bottom wall 18 extends an annular wall 21 which terminates in an upwardly opening mouth 22. The wall is generally conic in shape. On the interior of the wall 21 adjacent but below the mouth 22, lugs 24 are formed. The lugs are formed during the molding of the container body 14, and can serve as abutment members which are engaged by knock out rods (not shown) which serve to discharge the body 14 from a mold (not shown). The upper portion of each lug 24 is cylindrical and extends upwardly inside the part of the wall 21 adjacent the open mouth 22. As shown in FIG. 5, an upper face 25 of the lug 24 is flat and extends perpendicularly to the axis of the container body 14. The lugs 24 are provided with upright sockets 26 which receive plugs 27. Each of the plugs 27 includes a cylindrical shank 28 and a head 29 at one end of the shank 28. A lower portion of the shank 28 of each plug 27 is frictionally received inside one of the sockets 26 with an upper portion of the shank adjacent the head 29 being exposed and with the head 29 being exposed and spaced above the corresponding lug.

The plugs 27 support flexible straps 33 and 33A. The straps 33 and 33A are provided with spaced cross-shaped slits 34. Slits 34A and 34B adjacent opposite ends of the strap 33A are received on plugs 27A and 27B, respectively, as shown in FIG. 2. The straps 33 and 33A hold a block 36 of porous plastic flower holding material in the container 12. The block 36 can be formed of the material known as "oasis", a trademark of the Smithers Company. Stalks 37 (FIG. 3) of flowers can be mounted in the block 36 in the usual fashion forming holes 39 (FIG. 2) in the block 36 and the straps 33 and 33A hold the block 36 firmly in place in the container body 14 to prevent inadvertent release of the block 36. Water for keeping the flowers fresh can be held in the container by the block 36.

The container construction illustrated in the drawings and described above is subject to structural modification without departing from the spirit and scope of the appended claims.

What is claimed is:

1. A container for flowers which comprises a hollow body having a bottom and an annular wall terminating in an upwardly opening mouth, a plurality of lugs mounted on the interior of the wall adjacent the mouth, there being upright sockets in the lugs, plugs mounted in the sockets, each of the plugs having a shank received in one of the sockets and a head overlying the lug associated therewith and flexible straps spanning opposed plugs, openings in the straps adjacent ends thereof receiving the plugs, the straps being adapted to hold a block of flower holding material in the container.

2. A container as in claim 1 wherein each of the lugs has a face extending transversely of the axis of the body.

3. A container as in claim 1 wherein there is a block of porous flower holding material in the body and the straps hold the block in position in the body.

4. A container as in claim 1 wherein the wall extends upwardly and outwardly to the mouth and heads of the plugs are spaced radially inwardly of the wall.

* * * * *